US005519957A

United States Patent [19]

Iannetta

[11] Patent Number: 5,519,957

[45] Date of Patent: May 28, 1996

[54] GUN STOCK RECOIL MECHANISM

[76] Inventor: Luigi Iannetta, 6220 Disputed Road, Lasalle, Ontario, Canada, N9H 1X7

[21] Appl. No.: 220,928

[22] Filed: Mar. 31, 1994

[51] Int. Cl.[6] ..... F41C 23/08

[52] U.S. Cl. ..... 42/74; 42/73; 89/44.01

[58] Field of Search ..... 42/74, 73, 71.01, 42/1.06; 89/44.01

[56] References Cited

U.S. PATENT DOCUMENTS

| | | | |
|---|---|---|---|
| 311,755 | 2/1885 | Hermle | 42/74 |
| 2,754,608 | 7/1956 | Stieffel | 42/74 |
| 3,233,354 | 2/1966 | Ahearn | 42/74 |
| 4,055,016 | 10/1977 | Katsenes | 42/73 |
| 4,663,877 | 5/1987 | Bragg | 42/74 |
| 4,896,446 | 1/1990 | Gregory | 42/73 |
| 4,910,904 | 3/1990 | Rose | 42/74 |
| 5,031,348 | 7/1991 | Carey | 42/74 |
| 5,075,995 | 12/1991 | Kennel | 42/73 |

FOREIGN PATENT DOCUMENTS

| | | | |
|---|---|---|---|
| 3743092 | 7/1988 | Germany | 42/73 |
| 1559 | 10/1877 | United Kingdom | 42/74 |
| 23249 | 8/1893 | United Kingdom | 42/73 |

*Primary Examiner*—Stephen M. Johnson

[57] ABSTRACT

A comb and coil assembly for a shoulder firearm, the firearm having a stock with a butt end and a barrel end, includes a cheek piece which is connected to the upper surface of the stock. The cheek piece is movable between an extended position and a retracted position. A recoil mechanism is located in the interior of the stock and has a moving member which moves relative to the stock in response to the recoil of the firearm upon firing. The moving member and the cheek piece are connected by a cam and cam follower arrangement to substantially maintain the cheek piece in the extended position when the moving member is at rest and to permit the cheek piece to move to the retracted position upon the motion of the moving member in response to the recoil of the firearm.

29 Claims, 3 Drawing Sheets

GUN STOCK RECOIL MECHANISM

FIELD OF THE INVENTION

This invention relates in general to a recoil mechanism for a shoulder firearm having a stock, and more particularly to a recoil mechanism having an adjustable comb and an adjustable shoulder piece assembly.

BACKGROUND OF THE INVENTION

When a shoulder firearm is fired a recoil force pushes the gun towards the shoulder of the person, such as a trap shooter, firing the gun. When the trap shooter rests his or her cheek on the stock of the gun in order to aim the gun, the recoil force also causes the gun to move against the trap shooter's cheek when the gun is fired. In trap shooting competitions, the firearm will be fired many times in rapid succession. The recoil force will often cause bruising to the cheek and shoulder of the trap shooter.

Prior art recoil mechanisms have been devised to reduce the recoil force felt by the shoulder of the trap shooter as well as to alleviate the problem caused by motion of the gun against the cheek of the trap shooter. For example, in U. U.S. Pat. No. 5,031,348, granted Jul. 16, 1991 to Donald C. Carey, a gun stock assembly with coordinated comb and recoil is disclosed. The Carey patent discloses a comb piece coordinated with the shoulder piece and associated recoil assembly. The comb piece and shoulder piece remain stationary relative to each other during shooting while the recoil assembly absorbs the recoil. The comb piece provides a stationary cheek rest which is said to eliminate the cheek-chaffing action usually associated with the use of shoulder firms.

A similar device is disclosed in U.S. Pat. No. 4,896,446 granted Jan. 30, 1990, naming Glenn D. Gregory as inventor. The Gregory patent discloses an adjustable comb and butt plate assembly for shoulder firearms having a stock and a recoil reducing or absorbing means at the butt end of the stock. A butt plate is slidably mounted at the rear of the stock. A comb is slidably mounted on the stock. The comb and butt plate remain stationary relative to the shooter's head and body when the firearm is fired.

In addition, the Gregory and Carey patents disclose a butt plate or shoulder piece which is adjustable relative to the stock of the gun, as is the comb. Such adjustments may be made by moving the comb or butt plate on pins which extend outward from the stock of the gun.

The devices disclosed in the Carey and Gregory patents seek to avoid having a recoil force transmitted to the cheek of the trap shooter when the gun is fired by permitting the comb of the gun to slide relative to the stock of the gun. This does not prevent a force in a upward direction on the recoil of the gun causing the comb of the gun to hit the cheek of the shooter. In guns with a fixed comb, the transmission of such a force can cause bruising to the cheek of the shooter, especially upon repeated firings of the gun such are as necessary in trap shooting competitions and the like. Furthermore, a gun recoil will also produce forces which are lateral to the longitudinal axis of the gun. Such forces are not reduced by a shoulder piece which moves only parallel to the longitudinal axis of the gun. In addition, the adjustment of the comb and butt plate or shoulder piece described by the Gregory and Carey patents is limited.

Thus a recoil mechanism incorporating a comb and shoulder piece assembly which reduces the recoil force of a shoulder firearm as applied to the cheek of the trap shooter, which permits the shoulder piece to have some rotational movement when the gun recoils, and has a variably adjustable comb and shoulder piece, is desirable.

SUMMARY OF THE INVENTION

An object of one aspect of the present invention is to be provide an improved type of adjustable gun stock recoil mechanism.

According to one aspect of the present invention, there is provided a comb and recoil assembly for a shoulder firearm having a stock with a butt end and a barrel end, the assembly comprising, a cheek piece connected to the upper surface of the stock, movable between an extended position and a retracted position, a recoil mechanism located in the interior of the stock having a moving member which moves relative to the stock in response to the recoil of the firearm upon firing, and means for operatively connecting the moving member and the cheek piece for substantially maintaining the cheek piece in the extended position when the moving member is at rest and for permitting the cheek piece to move to a retracted position upon the motion of the moving member in response to the recoil of the firearm.

In accordance with another aspect of the present invention there is provided a comb, shoulder-piece, and recoil assembly for shoulder firearms having a stock, the assembly comprising, a cheek piece connected to the upper surface of the stock, movable between an extended position and a retracted position, a shoulder piece at the rear of the stock, moveable between a rest position and a recoil position, means for biasing the shoulder piece towards the rest position, and means for operatively connecting the cheek piece to the shoulder piece for maintaining the cheek piece in substantially fixed relation to the stock in the extended position when the shoulder piece is in the rest position and for permitting the movement of the cheek piece towards the stock to the retracted position when the shoulder piece is in the recoil position.

In accordance with the further aspect of the present invention there is provided a shoulder-piece assembly for a shoulder firearm comprising a stock having a butt end and a barrel end, the assembly comprising, a shoulder-piece at the butt end of the stock, moveable between a rest position and a recoil position, means for biasing the shoulder-piece towards the rest position, and pivot means located in the interior of the stock for retaining the shoulder-pie in substantially fixed relation to the stock when the shoulder-piece is in the rest position and for permitting limited pivotol movement of the shoulder-piece relative to the longitudinal axis of the stock when the shoulder-piece is in the recoil position.

In accordance with another aspect of the present invention there is provided an adjustable comb assembly for shoulder firms having a stock in which the comb comprises a cheek piece and a mounting piece, the mounting piece having a bracket for securing to the stock and having a vertical plate extending away from the stock when the bracket is secured to the stock, the cheek piece having an adjustment bracket for accepting the vertical plate and the adjustment bracket having means for releasably engaging the vertical plate at selectable points on the plate.

In accordance with a further aspect of the present invention there is provided an adjustable shoulder piece assembly for shoulder firearms in which the shoulder piece comprises a pad piece and a shoulder mounting piece, the shoulder mounting piece having a mounting bracket for securing to the firearm and having a plate extending away from the firearm when the mounting bracket is secured to the firearm, the pad piece having a pad bracket adapted to accept the plate and the pad bracket having means for releasably engaging the plate at selectable points on the plate.

Advantages of the present invention are that the force against the cheek of the trap shooter is reduced by the downward movement of the cheek piece relative to the stock of the gun when the gun recoils upon being shot. An advantage of an embodiment of the present invention is that the effect of the recoil of the gun against the shoulder of the shooter is reduced by the shoulder piece having a limited degree of rotational or pivotal movement relative to the stock of the gun upon the recoil of the gun. A further advantage of the invention is that the comb and the shoulder piece assemblies are able to be simply and effectively adjusted to a range of positions relative to the stock of the gun and can therefore be adjusted to fit the dimensions of the person using the gun.

BRIEF DESCRIPTION OF THE DRAWINGS

Detailed descriptions of two embodiments of the present invention are provided herein below with reference to the following drawings, in which.

DETAILED DESCRIPTION OF THE PREFERRED EMBODIMENTS

Figure 1:
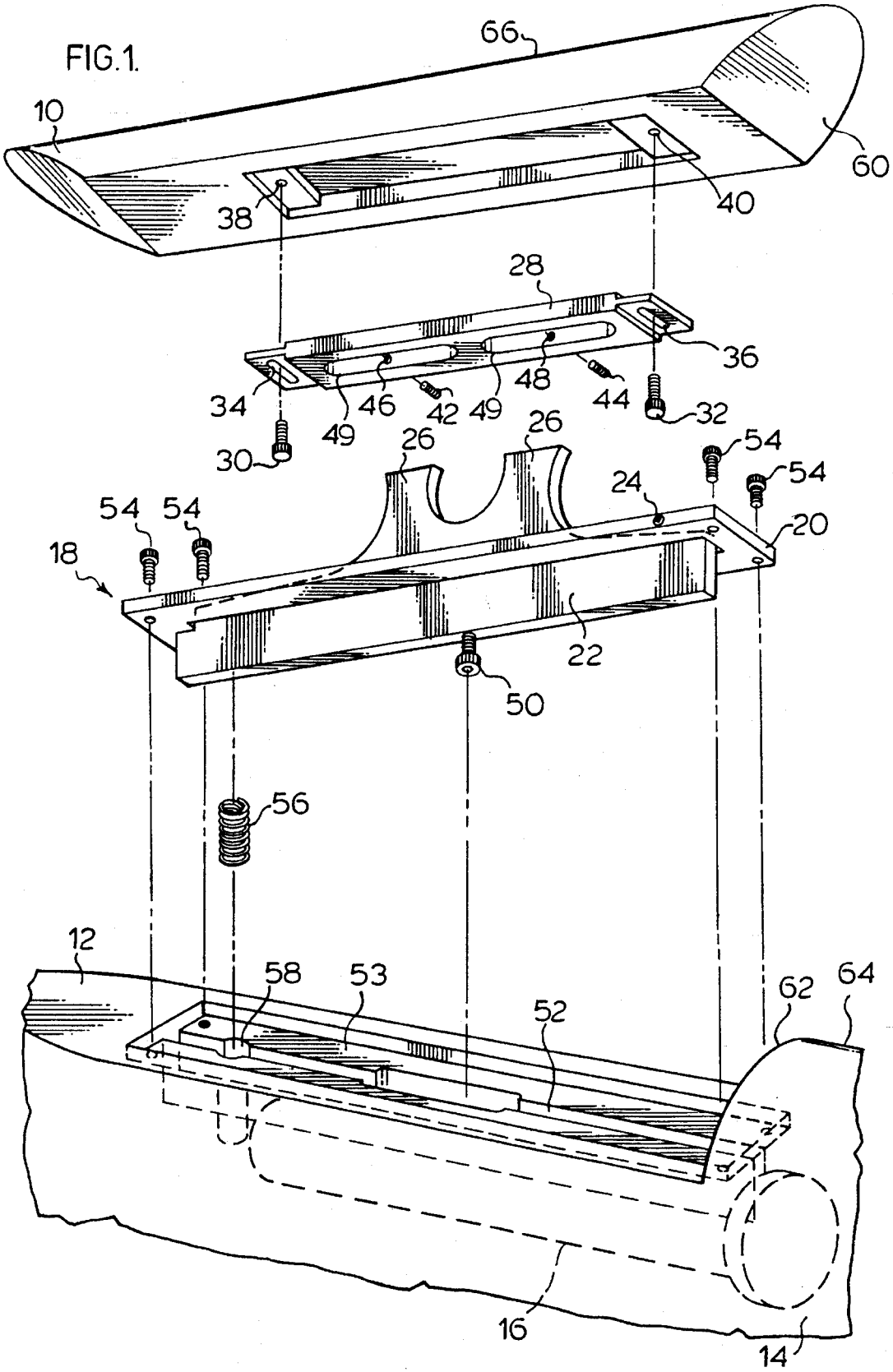
FIG. 1, in an exploded perspective view, illustrates the comb assembly and gun stock of a first embodiment of the present invention.

Referring to FIG. 1, there is illustrated in an exploded perspective view, the comb assembly and gun stock of a first embodiment of the present invention. In this description, the barrel end of the gun is described as the forward end and the butt end the rearward end. The gun is described as being oriented as it would be when being shot. The comb assembly and gun stock include a cheek piece 10 intended to be mounted on a gun stock 12.

The gun stock 12 has a bore 16 extending longitudinally from the butt end 14 of the gun stock 12. The cheek piece 10 is connected to a mounting mechanism 18. The mounting mechanism 18 has a mounting bracket 20 and a swing plate 22 to which the cheek piece 10 is detachably and adjustably secured. The mounting bracket 20 and the swing plate 22 are attached to each other by a hinge 24 at the rear end of each of the mounting plate 20 and swing plate 22.

The swing plate 22 has mounting lugs 26 which extend upwardly from swing plate 22. An adjustment bracket 28 is affixed to the cheek piece 10 by screws 30, 32 which screws pass through slots 34, 36 in adjustment bracket 28, respectively. Screws 30, 32 couple with threaded bored 38, 40 in cheek piece 10. Screws 42, 44 pass through threaded bores 46, 48 in adjustment bracket 28 to adjustably secure the bracket to the lugs 26 of swing plate 22, when the lugs are introduced into slots 49 of bracket 28.

A pin 50 extends downwardly from the swing plate 22 through a opening 52 in stock 12. The opening 52 extends from the top of the stock 12 into bore 16. The pin 50 is designed to act as a cam follower to ride on the cylindrical surface of a conical piece 54, shown in FIG. 2.

The mounting plate 20 is affixed to recessed portion 53 of the top surface of the stock 12 by screws 54. A helic spring 56 is set in cavity 58 in the upper surface of the stock 12. When cheek piece 10 is mounted on the stock 12 using adjustment bracket 28 and mounting mechanism 18, end 60 of cheek piece 10 is adjacent to face 62 of stock 12. Upper surface 66 of cheek piece 10 is relatively flush with upper surface 64 of stock 12.

Figure 2:
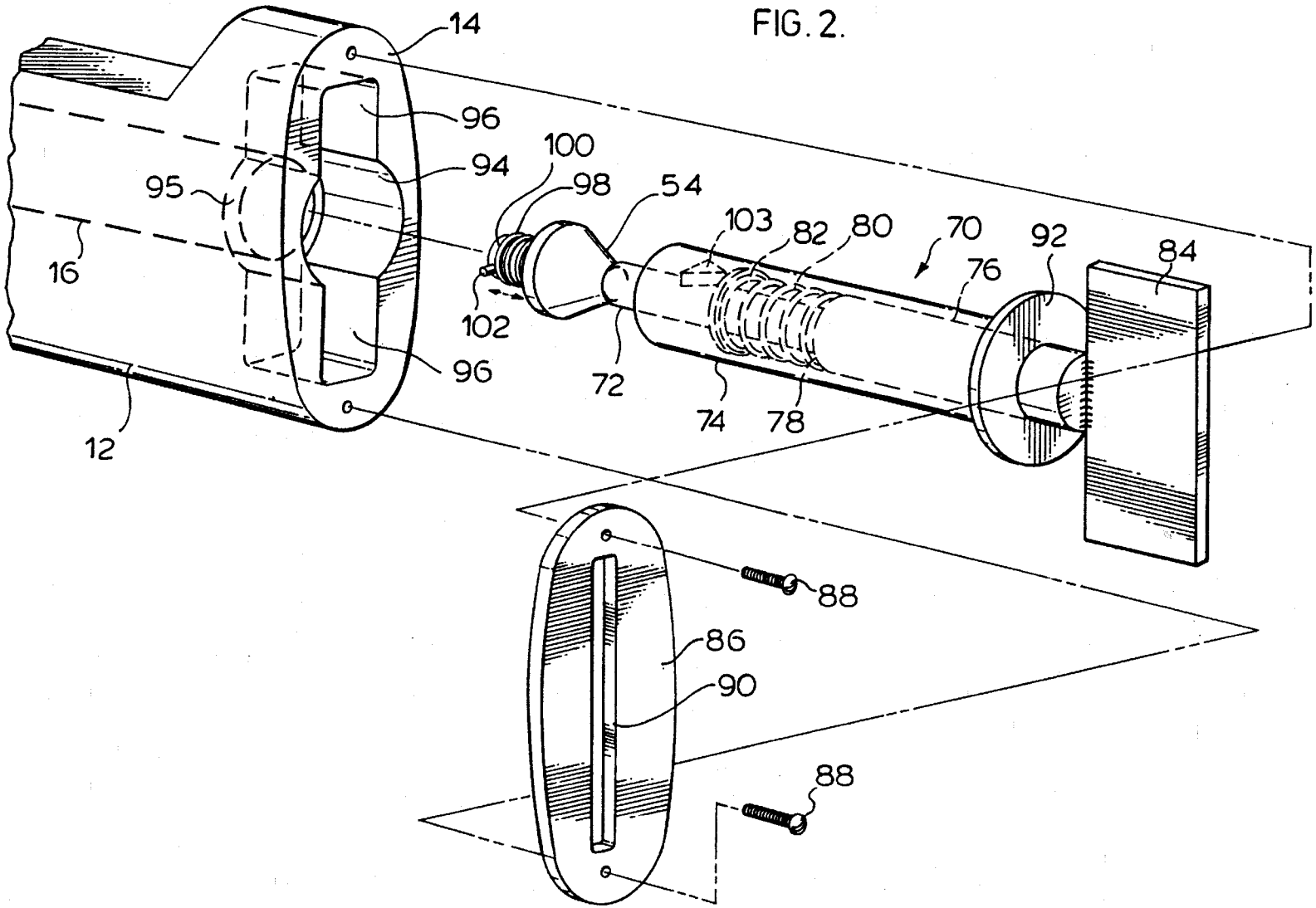
FIG. 2, in an exploded view, illustrates the gun stock and recoil mechanism of the embodiment of the present invention of FIG. 1.

Turning to FIG. 2, there is illustrated, in an exploded view, the gun stock and recoil mechanism of the embodiment of the present invention of FIG. 1. A recoil mechanism 70 is designed to be mounted in the gun stock 12 and to extend within the bore 16. The recoil mechanism 70 has a conical piece 54 which is mounted on shaft 72 and is designed to be accommodated within bore 16. Shaft 72 extends within housing 74 and is connected to column 76 such that the longitudinal axis of shaft 72 is aligned with the longitudinal axis of column 76. Column 76 has a radius greater than that of shaft 72 and there is therefore a shoulder 78 at the point of connection of column 76 and shaft 72. A helical spring 80 is seated between shoulder 78 and a lip 82 on the interior of housing 74. The spring 80 biases the column 76 outwardly (rearwardly) from the stock 12.

Column 76 is connected at its rearward end to attachment plate 84. When recoil mechanism 70 is installed in bore 16 of the stock 12, a end plate 86 is installed on the end 14 of the stock 12 by way of screws 88. The attachment plate 84 passes through opening 90 in end plate 86. The opening 90 in end plate 86 has a width such that the attachment plate 84 slides freely but snugly through the opening.

The recoil mechanism 70 has a ting flange 92 at its rearward end. The flange 92 is designed to be seated, in recess 94 formed in the end 14 of the stock 12, against lip 95 formed in recess 94. The recess 94 has vertically extending portions 96 which receive attachment plate 84.

Recoil mechanism 70 also has a return spring 98 which is mounted on a sheath 100 which covers the portion of shaft 72 which extends past conical piece 54 towards the barrel portion of the gun. The rearward end of the spring 98 abuts the forward end of conical piece 54, while the forward end of spring 98 is held in place by pin 102 extending from the sheath 100. Conical piece 54 has a central cavity which permits it to slide over sheath 100.

The recoil mechanism 70 also has a triangular member 103 mounted on shaft 72. The triangular member 103 is located such that it mates with an appropriately dimensioned triangular notch in the forward end of housing 74 (not shown). The notch is open at the forward end of housing 74 such that the triangular member 103 may be moved in a forward direction. When the triangular member is mated in the notch the shaft 72 is prevented from rotational movement.

Figure 3:
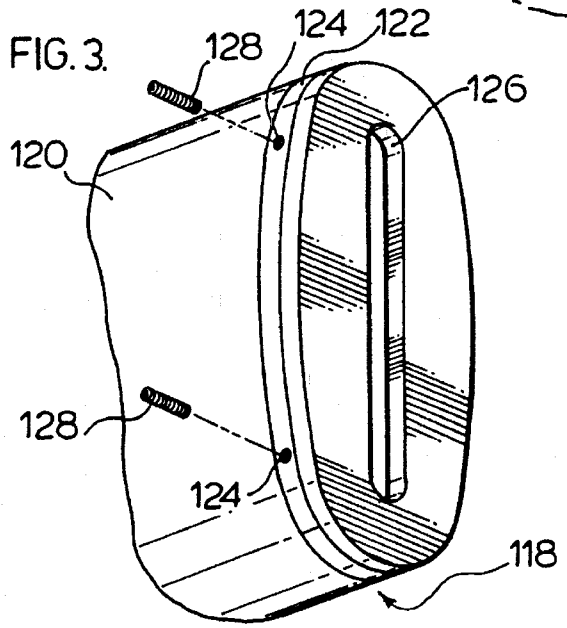
FIG. 3, in an perspective view, illustrates the shoulder piece of the embodiment of the FIG. 1.

Turning to FIG. 3, there is illustrated, in an perspective view, the shoulder piece 118 of the embodiment of the FIG. 1. Shoulder pad 120 is made of rubber or other elastomeric material and is designed to fit comfortably against the shoulder of the trap shooter. Plate 122 is affixed to one end of the shoulder pad 120. Threaded bores 124 extend from the side wall of plate 122 to central slot 126 of plate 122. Screws 128 are introduced into threaded bores 124 to secure the shoulder piece 118 to attachment plate 84 illustrated in FIG. 2.

Figure 4:
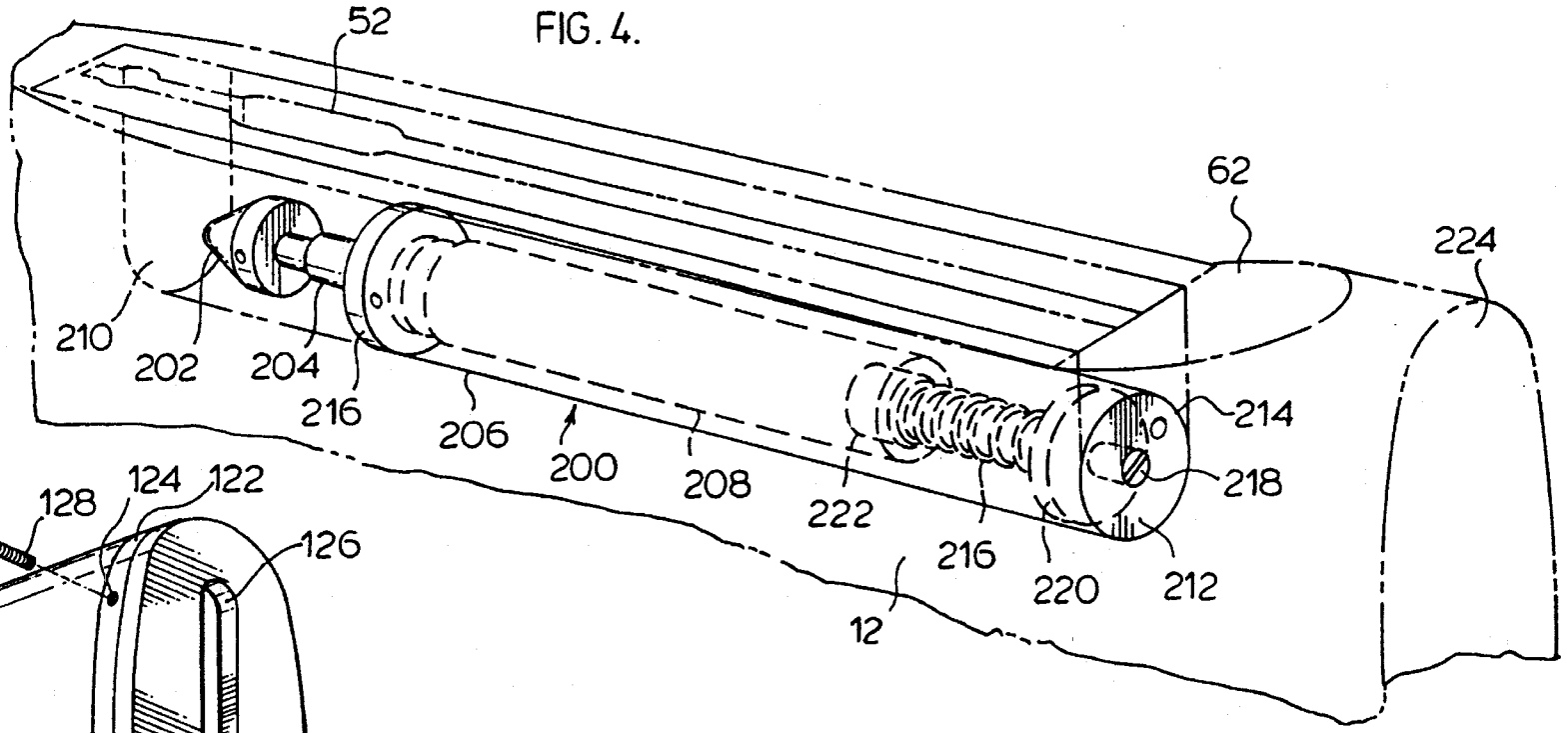
FIG. 4, in a perspective view, illustrates the recoil mechanism of a second embodiment of the invention.

Turning to FIG. 4, there is illustrated, in a perspective view, the recoil mechanism 200 of a second embodiment of the invention. The recoil mechanism 200 has a conical piece 202 mounted at the forward end of a shaft 204. The rearward end of shaft 204 is attached to a weighted member 208 contained in housing 206. The recoil mechanism 200 of the second embodiment is installed in cavity 210 in the stock 12. Cavity 210 is similarly designed to the bore 16 in the embodiment of FIG. 1 but the cavity 210 does not extend to the rear end of the stock 12. Bore 16 is connected to opening 52 in stock 12 as is set out above with respect to the embodiment of FIG. 1. The rearward end 212 of housing 206 abuts the end 214 of cavity 210.

The forward end 216 of the housing 206 has on opening (not shown) through which the shaft 204 passes and with respect to which the shaft 204 is free to move along the shaft's longitudinal axis. The shaft 204 is connected to the weighted member 208. The weighted member 208 is permitted a degree of movement along its longitudinal axis within the housing 206. At the rearward end of the weighted member 208 there is a spring 216 which is mounted on a bolt 218. A threaded washer 220 is also mounted on bolt 218 and the rearward end of spring 216 abuts the washer 220. The other end of the spring 216 is seated in a circular step in bore 222 in the end of weighted member 208. The bore 222 is of a sufficient depth to permit a portion of bolt 218 to enter the cavity 222 when the weighted member 208 moves rearwardly against the biassing force of spring 216.

In the embodiment of the invention shown in FIG. 4, a cheek piece and mounting assembly as shown in FIG. 1 are used. The pin 50 will co-operate with conical piece 202, as is set out below in further detail. The cheek piece 10 is mounted above the slot 52 in the stock 12 and rearward end 60 of cheek piece 10 is adjacent to face 62 of gun stock 12.

According to the embodiment of the invention illustrated in FIGS. 1–3, prior to use of the gun, the recoil mechanism 70 is introduced into bore 16. The attachment plate 84 fits within recess 94 and extending portions 96 in end 14 of stock 12. End plate 86 is then affixed to the end 14 of the stock 12 and a portion of attachment plate 84 extends through opening 90 in end plate 86. Shoulder piece 118 is then attached to the portion of attachment plate 84 which extends through opening 90. Shoulder piece 118 is able to be adjusted to suit the preferences of the trap shooter by placing attachment plate 84 in central slot 126 of shoulder piece 118. The central slot 126 has a length and depth greater than the corresponding dimensions of the attachment plate 84 and therefore the trap shooter may adjust the angle and position of the shoulder piece relative to the stock 12. When the desired position of the shoulder piece 118 is attained, the screws 128 are introduced in threaded bores 124 and tightened against the attachment plate 84 so as to secure the shoulder piece 118 in the desired location.

Also prior to use of the gun, the mounting mechanism is affixed to the top surface of stock 12 in recessed area 53 such that the swing plate 22 extends through opening 52 in the upper surface of the stock 12. Spring 56 must first be introduced in cavity 58 formed in opening 52. Screws 54 are used to secure the mounting mechanism to the stock 12.

The cheek piece 10 is attached to the gun by way of adjustment bracket 28 and mounting mechanism 18. The screws 30, 32 are introduced in slots 34, 36 in adjustment bracket 28. The freedom of movement of the screws in the slots permits the angle and lateral position of the cheek piece 10 to be adjusted relative to the stock 12. When the desired adjustment is made the screws 30, 32 are tightened and the cheek piece 10 is fixed in relation to the adjustment bracket 28.

The lugs 26 are then introduced in slots 49 of adjustment bracket 28. The height, horizontal angle, and longitudinal position of the cheek piece 10 may then be adjusted by moving the position of the lugs relative to the adjustment bracket. When the desired position is achieved, the screws 42, 44 are introduced into bores 46, 48, respectively and are tightened against the faces of lugs 26 to secure the cheek piece 10 to the mounting mechanism 18.

When the recoil mechanism 70 and the cheek piece 10 and mounting mechanism 18 have been installed in the stock 12, as described above, the pin 50 on the bottom edge of swing plate 22 will rest on the upper surface of conical piece 54. Pin 50 may be threaded in order to permit the pin to be adjusted to provide further adjustment of the position of the cheek piece 10.

When the shoulder firearm is not being fired, or otherwise manipulated, the recoil mechanism 70, the cheek piece 10 and mounting mechanism 18 cooperate such that the cheek piece 10 is maintained in the fixed position selected by the trap shooter in adjusting the bracket 28. The shoulder piece 118 is also held in a fixed position by the biassing force of spring 80 and the locking function of triangular member 103.

When the gun is to be fired, the shoulder pad 120 is placed against the shoulder of the trap shooter and the trap shooter's cheek is placed on cheek piece 10 of the comb. As described above, both the cheek piece 10 and shoulder piece 118 are maintained in fixed relationship with each other and the gun stock by the force of spring 80. This provides the stability necessary for accurate aiming of the firearm. When the gun is fired a recoil force causes the stock 12 to move rearwardly and upwardly. This recoil force overcomes the biasing force of spring 80 and causes shoulder piece 118 to move towards the stock 12. The spring 80 absorbs the recoil force but permits the conical piece 54 to move towards the barrel portion of the gun and away from the butt. As a result of this motion, pin 50 acts as a cam follower and moves down the surface of conical piece 54 acting as a cam. As a result, swing plate 22 pivots about hinge 24 and the front portion of cheek piece 10 is free to move downwardly. As a result, the upward force caused by the recoil of the gun which moves the comb against the trap shooter's cheek has less impact on the trap shooter's cheek than if the cheek piece were stationary relative to the stock. Spring 56 acts to slow the downward motion of the cheek piece and to prevent an abrupt end to the motion as the cheek piece reaches the retracted position.

The recoil force against the trap shooter's shoulder is lessened. The relative motion between the shoulder piece 118 and the stock 12, causes triangular piece 103 to move forwards away from housing 74. As triangular piece 80 moves, the shaft 72 is free to rotate (pivot about the longitudinal axis of the stock), as is shoulder piece 118 which is connected to shaft 72 by way of column 76. Thus when the gun is in the recoil position the shoulder piece is able to rotate against the trap shooter's shoulder. Rotational forces which would otherwise act directly on the trap shooter's shoulder are translated into rotational or pivotal movement of the stock relative to the shoulder piece.

Following the recoil of the gun, the return of the cheek piece 10 to the rest position is slowed by spring 98, shown in FIG. 2 which acts against the force exerted by spring 80 in returning the shoulder piece 118 to an extended position following the recoil of the gun. The spring 98 prevents the cheek piece 10 from moving rapidly upwards (and striking the trap shooter's cheek) once the recoil force has been absorbed and dissipated.

Turning to the embodiment of the invention shown in FIG. 4, the firing of a gun will result in the movement of the cheek piece 10, but by means of the mechanism shown in FIG. 4. The firing of the gun will result in the rearward motion (i.e. recoil) of the gun, including the stock 12 and the recoil mechanism 200, shown in FIG. 4. The end of the stock 224 will strike the shoulder of the trap shooter and therefore reach the end of its rearward travel. The inertial force of the weighted member 208 will cause the member to continue to move rearwardly even after the stock 12 has reached the end of its travel. The inertial force of the weighted member 208 will overcome the biassing force of spring 216 and as a result shaft 204 and conical piece 202 will move rearwardly in relation to the gun stock 12.

In the embodiment of FIG. 4, the cheek piece arrangement shown in FIG. 1 is used and pin 50 rides on the conical piece 202. As the conical piece 202 moves rearwardly relative to the stock 12, the pin 50 moves downwardly. Thus upon the end of the travel of the stock due to the recoil force of the gun, the cheek piece 10 swings downwardly around hinge 24. The effect is that the force against the cheek of the trap shooter is lessened..

In summary, a comb and shoulder piece assembly for a shoulder firearm is provided with a means for reducing the effects of the recoil of the gun to the trap shooter when the gun is fired and for adjusting the comb and shoulder piece to fit the dimensions of the trap shooter.

Other variations and modifications of the invention are possible. For example, the biasing of the shoulder piece may be accomplished by a hydraulic methods as opposed to springs. All such modifications or variations are believed to be within the sphere and scope of the invention as defined by the claims appended hereto.

I claim:

1. An assembly for a shoulder firearm comprising a stock having an upper surface, an interior portion, a butt end and a barrel end, and a longitudinal axis, the assembly comprising, a cheek piece connected to the upper surface of the stock, movable between an extended position and a retracted position, a recoil mechanism located in the interior portion of the stock having a moving member which moves relative to the stock in response to the recoil of the firearm upon firing, and means for operatively connecting the moving member and the cheek piece for substantially maintaining the cheek piece in the extended position when the moving member is at rest and for permitting the cheek piece to move to the retracted position upon the motion of the moving member in response to a recoil caused by firing the firearm.

2. The assembly of claim 1 wherein the moving member comprises a conical member comprising a tapered surface tapering away from the butt end of the firearm, the recoil mechanism further comprising an inertial member, connected to the conical member, and a biassing means for maintaining the inertial member and the conical member in a substantially fixed relationship with respect to the stock of the firearm when the firearm is being aimed prior to firing, means for permitting the inertial member and the conical member to move relative to the stock, whereby such movement occurs when upon firing the firearm there is caused a recoil motion of the stock, which recoil motion is arrested by a shoulder of a shooter firing the firearm, the inertial member and the conical member having an inertial force which overcomes the biassing force exerted by the biassing means, the means for operatively connecting the moving member and the cheek piece further comprises a cam follower for riding on the tapered surface of the conical member.

3. The assembly of claim 2 wherein the cam follower comprises a screw which can be adjusted to provide different effective lengths of the cam follower.

4. The assembly of claim 2 wherein the means for operatively connecting the moving member and the cheek piece further comprises a pair of first and second hingedly connected plates, the second hingedly connected plate having a bottom portion, the first plate being affixed to the stock of the firearm and the second plate being connected to the cheek piece, the hinged connection of the first and second plates permitting the cheek piece to move between the extended and the retracted positions.

5. The assembly of claim 4 wherein the cam follower is connected to the bottom portion of the second plate.

6. The assembly of claim 4 wherein the cheek piece has an adjustment bracket comprising a cavity and an outer edge adapted to accept the second plate and the adjustment bracket has means for releasably engaging the second plate at selectable points on the second plate.

7. The assembly of claim 6 in which the means for releasably engaging the second plate comprises at least two threaded bores in the adjustment bracket extending from the cavity in the adjustment bracket to the outer edge of the adjustment bracket and further comprises a screw for each of the threaded bores.

8. The assembly of claim 6 in which the adjustable bracket comprises two slots which are adapted to receive at least one screw in each said slot for adjustably securing the adjustable bracket to the cheek piece.

9. The assembly of claim 2 in which the inertial member is cylindrical and in which the means for permitting the inertial member and the conical member to move relative to the stock comprises a sleeve disposed about the inertial member whereby the inertial member may slide in a direction substantially parallel to the longitudinal axis of the stock of the firearm.

10. The assembly of claim 2 in which the biassing means comprises a helical spring having first and second ends, the spring being mounted on a pin, the pin being connected to a disk against which the first end of the spring is disposed, the inertial member further comprising a bore having a shoulder located at an intermediate point on the bore, the bore being capable of receiving the spring and the pin, and the shoulder being configured to provide a seat for the second end of the spring.

11. The assembly of claim 1 further comprising a shoulder-piece movable relative to the stock upon the recoil of the firearm, wherein the recoil mechanism is operatively connected to the shoulder-piece for motion of the moving member in response to motion of the shoulder-piece.

12. The assembly of claim 1 further comprising a means for retarding the motion of the cheek piece when moving between the extended position and the retracted position.

13. The assembly of claim 12 in which the means for retarding the motion of the cheek piece comprises a helical spring mounted in the stock of the firearm and disposed such that the cheek piece compresses the helical spring as the cheek piece moves towards the retracted position.

14. An assembly for shoulder firearms having a stock comprising an upper surface, a forward end and a rearward end, the assembly comprising, a cheek piece connected to the upper surface of the stock, movable between an extended position and a retracted position, a shoulder piece at the rearward end of the stock, moveable between a rest position and a recoil position, means for biasing the shoulder piece towards the rest position, and means for operatively connecting the cheek piece to the shoulder piece for maintaining the cheek piece in substantially fixed relation to the stock in the extended position when the shoulder piece is in the rest position and for permitting the movement of the cheek piece towards the stock to the retracted position when the shoulder piece is in the recoil position.

15. The assembly of claim 14, wherein the means for operatively connecting the cheek piece to the shoulder piece comprises a means for absorbing a recoil force resulting from the recoil of the firearm generated by firing the firearm.

16. The assembly of claim 15, wherein the means for operatively connecting the cheek piece to the shoulder piece further comprises a conical member having a tapered surface tapering towards the rearward end of the stock, the conical member being operatively connected to the means for absorbing a recoil force and being operatively connected to the cheek piece by a cam follower associated with the cheek piece for riding on the tapered surface of the conical member, and the assembly further comprising a means for connecting the shoulder-piece to the recoil absorbing means, whereby upon firing the firearm the conical member moves towards the forward end of the stock and the action of the cam follower causes the cheek piece to move towards the stock.

17. The assembly of claim 16, wherein the means for absorbing a recoil force comprises a cylindrical member having a barrel end and a butt end, and having a shoulder facing the forward end of the firearm, a sleeve arranged about and in concentric relation to the cylindrical member, having an internal flange, a helical spring disposed between the shoulder of the cylindrical member and the flange of the sleeve, such that a force biases the cylindrical member towards the rearward end of the firearm.

18. The assembly of claim 17, wherein the conical member is mounted on the cylindrical member in proximity to the barrel end of the cylindrical member.

19. The assembly of claim 17, wherein a plate is affixed to the butt end of the cylindrical member for attachment of the shoulder-piece.

20. The assembly of claim 19, further comprising a means for releasably engaging the shoulder-piece to the plate at selectable points on the plate.

21. The assembly of claim 20, wherein the means for releasably engaging the shoulder-piece comprises an outer edge, a cavity in the shoulder-piece for accepting the plate, at least two threaded bores in the shoulder-piece extending from the outer edge of the shoulder-piece to the cavity, and screws for introduction into the bores for engagement with the plate when the plate is introduced into the cavity.

22. The assembly of claim 21 further comprising a pair of first and second hingedly connected plates, the first plate being affixed to the stock of the firearm and the second plate being connected to the cheek piece, the hinged connection of the first and second plates permitting the cheek piece to move between the extended and the retracted positions.

23. The assembly of claim 22 wherein the cam follower is connected to the bottom portion of the second plate.

24. The assembly of claim 22 wherein the cheek piece has an adjustment bracket having a central cavity for accepting the second plate and the adjustment bracket has means for releasably engaging the second plate at selectable points on the second plate.

25. The assembly of claim 24 in which the means for releasably engaging the second plate comprises at least two threaded bores in the adjustable bracket extending from the cavity in the adjustment bracket to the outer edge of the adjustment bracket and further comprises a screw for each of the threaded bores.

26. The assembly of claim 25 in which the adjustment bracket comprises two slots for receiving a screw in each slot for adjustment securing the adjustment bracket to the cheek piece.

27. The assembly of claim 17 further comprising means for retaining the shoulder-piece in substantially fixed relation to the stock when the shoulder-piece is in the rest position and for permitting limited pivotal movement of the shoulder-piece relative to the longitudinal axis of the stock when the shoulder-piece is in the recoil position.

28. The assembly of claim 14, further comprising a means for retarding the return of the cheek piece to the extended position following recoil of the firearm.

29. The assembly of claim 28, in which the means for retarding the return of the cheek piece comprises a helical spring arranged to counteract the means for biasing the shoulder-piece to the rest position following recoil of the firearm.

* * * * *

UNITED STATES PATENT AND TRADEMARK OFFICE

CERTIFICATE OF CORRECTION

PATENT NO. : 5,519,957

DATED : May 28, 1996

INVENTOR(S) : Iannetta

It is certified that error appears in the above-indentified patent and that said Letters Patent is hereby corrected as shown below:

Column 1, line 23, "U.U.S." should be --U.S.--;
line 33, "firms" should be --firearms--;
line 53, "a upward" should be --an upward--;

Column 2, line 7, "be" should be deleted;
line 47, "shoulder-pie" should be --shoulder-piece--;
line 55, "firms" should be --firearms--;

Column 3, line 33, "an" should be --a--;
line 63, "bored" should be --bores--;

UNITED STATES PATENT AND TRADEMARK OFFICE

CERTIFICATE OF CORRECTION

PATENT NO. : 5,519,957 Page 2 of 2

DATED : May 28, 1996

INVENTOR(S) : Iannetta

It is certified that error appears in the above-indentified patent and that said Letters Patent is hereby corrected as shown below:

Column 4, line 2, "a opening" should be --an opening--;
line 3, "12" should be --14--;
line 7, "helic" should be --helical--;
line 31, "a end" should be --an end--;
line 35, "ting" should be --ring--;
line 58, "an" should be --a--;
Column 10, line 29, "adjustable" should be --adjustment--;

Signed and Sealed this

Twenty-seventh Day of August, 1996

Bruce Lehman

*Attest:*

BRUCE LEHMAN

*Attesting Officer*

*Commissioner of Patents and Trademarks*